US008905536B2

(12) United States Patent
Kato

(10) Patent No.: US 8,905,536 B2
(45) Date of Patent: Dec. 9, 2014

(54) DRYING APPARATUS, RECORDING APPARATUS HAVING THE DRYING APPARATUS, AND METHOD OF FABRICATING NIPPING MEMBER

(75) Inventor: Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 166 days.

(21) Appl. No.: 13/434,625

(22) Filed: Mar. 29, 2012

(65) Prior Publication Data

US 2012/0249704 A1 Oct. 4, 2012

(30) Foreign Application Priority Data

Mar. 31, 2011 (JP) ..... 2011-077590

(51) Int. Cl.
*B41J 2/165* (2006.01)
*B41J 11/00* (2006.01)
*B41J 13/076* (2006.01)

(52) U.S. Cl.
CPC ..... *B41J 11/002* (2013.01); *B41J 13/076* (2013.01)
USPC ..... 347/104

(58) Field of Classification Search
None
See application file for complete search history.

(56) References Cited

U.S. PATENT DOCUMENTS

| | | | | |
|---|---|---|---|---|
| 6,277,104 | B1 * | 8/2001 | Lasko et al. | 604/385.01 |
| 2008/0063445 | A1 * | 3/2008 | Imai et al. | 399/333 |
| 2008/0094459 | A1 | 4/2008 | Sakagami | |
| 2010/0271415 | A1 | 10/2010 | Sakagami | |

FOREIGN PATENT DOCUMENTS

| | | | |
|---|---|---|---|
| JP | H09-254460 | A | 9/1997 |
| JP | 2000-221835 | A | 8/2000 |
| JP | 2001-179959 | A | 7/2001 |
| JP | 2002-147952 | A | 5/2002 |
| JP | 2004-130615 | A | 4/2004 |
| JP | 2008-120072 | A | 5/2008 |

OTHER PUBLICATIONS

Japan Patent Office, Notification of Reasons for Refusal for Japanese Patent Application No. 2011-077590 (counterpart to above-captioned patent application), mailed Jul. 16, 2013.

* cited by examiner

*Primary Examiner* — Alejandro Valencia
(74) *Attorney, Agent, or Firm* — Baker Botts L.L.P.

(57) ABSTRACT

A drying apparatus provided with a heating portion which includes two nipping members and which is configured to heat a recording medium being nipped by and between the two nipping members, wherein one of the two nipping members is disposed in opposition to the other of the two nipping members, and includes an air-permeable elastic member, and a liquid-repellant film which covers a surface of the elastic member in opposition to the above-indicated other nipping member and which has a plurality of through-holes formed therethrough.

17 Claims, 13 Drawing Sheets

DRYING APPARATUS, RECORDING APPARATUS HAVING THE DRYING APPARATUS, AND METHOD OF FABRICATING NIPPING MEMBER

CROSS REFERENCE TO RELATED APPLICATION

The present application claims the priority from Japanese Patent Application No. 2011-077590 filed Mar. 31, 2011, the disclosure of which is herein incorporated by reference in its entirety.

BACKGROUND OF THE INVENTION

1. Field of the Invention

The present invention relates in general to a drying apparatus for heating and drying a recording medium, and a recording apparatus provided with the drying apparatus, and more particularly to the drying apparatus and recording apparatus which permit effective removal of a vapor generated as a result of a heating operation of the drying apparatus.

2. Description of Related Art

There is known a drying apparatus provided with two nipping members in the form of a heating roller and a pressing or nipping roller. This drying apparatus is configured to heat a recording medium while nipping the recording medium between the heating and pressing rollers, for vaporizing a liquid from the recording medium to thereby dry the recording medium. In the drying apparatus, the pressing roller has a PFA tube (liquid-repellant film) which contacts the recording medium.

SUMMARY OF THE INVENTION

In the drying apparatus described above, the liquid-repellant film of one of the two nipping members contacts the recording medium while the recording medium is nipped by and between the two nipping members, so that a vapor generated from the liquid carried by the recording medium tends to stay in a region of contact of the recording medium with the above-indicated one of the two nipping members. Accordingly, the drying apparatus suffers from a problem of a relatively long time required for drying the recording medium, due to the vapor staying in the above-indicated region.

The present invention was made in view of the background art described above. It is therefore an object of the present invention to provide a drying apparatus which permits rapid drying of a recording medium.

The object indicated above can be achieved according to a first aspect of this invention, which provides a drying apparatus comprising a heating portion comprising two nipping members and configured to heat a medium being nipped by and between the two nipping members, wherein one of the two nipping members is disposed in opposition to the other of the two nipping members, and comprises an elastic member having an air-permeable property, and a film which covers a surface of the elastic member in opposition to the above-indicated other nipping member and which has a liquid-repellant property, and wherein the film has a plurality of through-holes formed therethrough.

The object indicated above can also be achieved according to a second aspect of the invention, which provides a recording apparatus comprising: a recording head having a liquid-ejecting surface and configured to record an image on a recording medium, with a liquid ejected from the liquid-ejecting surface; and a drying apparatus constructed according to the first aspect of the invention described above, wherein the heating portion heats the recording medium as the above-described medium on which the image has been recorded by the recording head.

The object indicated above can also be achieved according to a third aspect of the invention, which provides a method of fabricating one of two nipping members of a heating portion of a drying apparatus, the heating portion being configured to heat a medium being nipped by and between the two nipping members, the above-indicated one of the two nipping members being disposed in opposition to the other of the two nipping members, and comprising an elastic member having an air-permeable property, and a film which covers a surface of the elastic member in opposition to the above-indicated other nipping member and which has a liquid-repellant property, the method comprising a step of forming a plurality of through-holes through the film, by piercing needle members into the film in a direction from one of opposite surfaces of the film which is remote from the elastic member, toward the other of the opposite surfaces, such that the through-holes are formed through respective raised portions which are formed by the needle members pierced into the film and which protrude toward the elastic member.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which.

DETAILED DESCRIPTION OF THE PREFERRED EMBODIMENTS

The preferred embodiments of this invention will be described by reference to the accompanying drawings.

First Embodiment

<Arrangement of Ink-Jet Printer 1>

Figure 1:
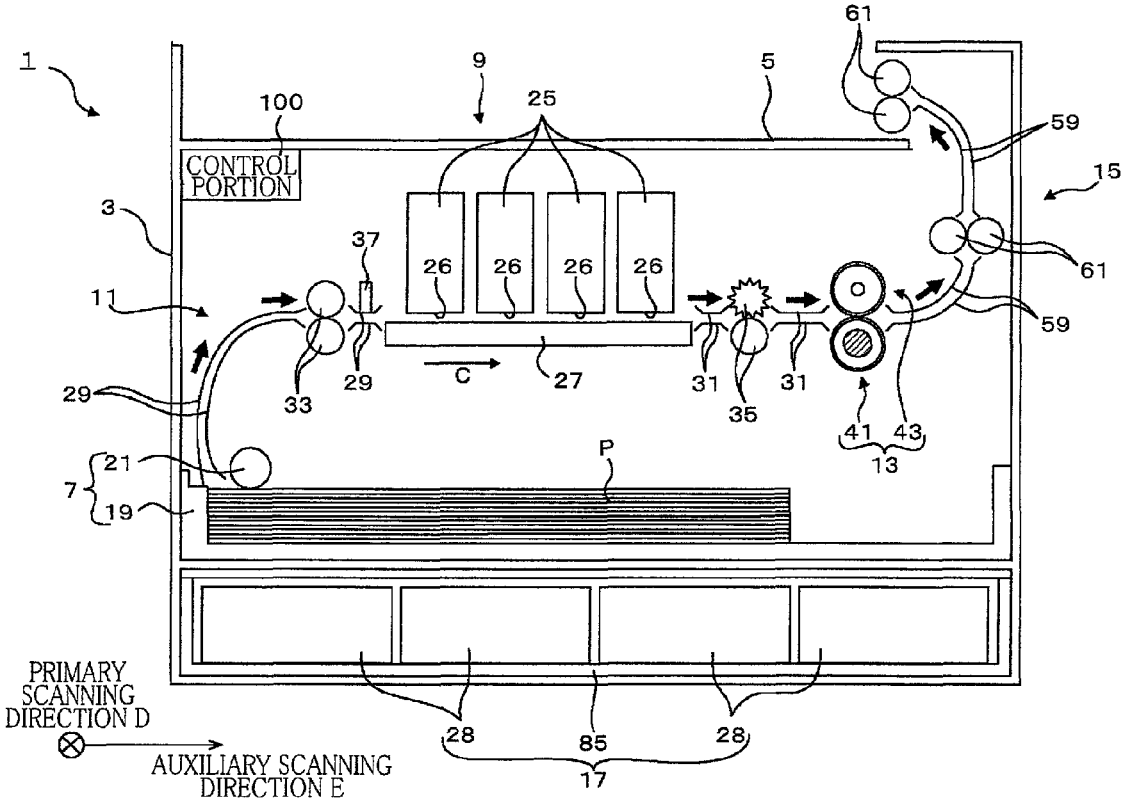
FIG. 1 is a schematic side elevational view showing an internal arrangement of an ink-jet printer according to a first embodiment of this invention.

An inkjet-printer 1 constructed according to the first embodiment of this invention is shown in FIG. 1. This ink-jet printer 1 has a housing 3 of a rectangular box construction. The housing 3 has a sheet receiver tray 5 at its upper part. The housing 3 also has a sheet supply unit 7, a printing portion 9, a sheet feeding portion 11, a heating portion 13, a sheet ejecting portion 15 and a cartridge unit 17, and accommodates therein a control portion configured to control their operations. Within the housing 3, there is provided a sheet feeding path along which a sheet of paper P is fed as indicated by thick arrow-headed lines in FIG. 1. The sheet feeding portion 11 is configured to feed the paper sheet P from the sheet supply unit 7 to the heating portion 13 through the printing portion 9. The heating portion 13 is configured to feed the paper sheet P from the sheet feeding portion 11 to the sheet ejecting portion 15, and to heat the paper sheet P while nipping the paper sheet P. The sheet ejecting portion 15 is configured to feed the paper sheet P from the heating portion 13 to the sheet receiver tray 5. The above-indicated unit and portions will be described below.

<Sheet Supply Unit 7>

The sheet supply unit 7 has a sheet supply cassette 19, and a sheet supply roller 21. The sheet supply unit 7 is provided to deliver the paper sheet P toward the sheet feeding portion 11.

The sheet supply cassette 19 is disposed in its lower part, and is a member of a box construction that is open upwards. The sheet supply cassette 19 can accommodate various sizes of the paper sheets P. The sheet supply roller 21 is disposed above the sheet supply cassette 19, and is connected to and rotated by a sheet supply motor 23 (shown in FIG. 6). The sheet supply roller 21 is rotated in contact with the uppermost one of the paper sheets P stacked in the sheet supply cassette 19, to deliver the uppermost paper sheet P toward a sheet guide 29 of the sheet feeding portion 11.

<Printing Portion 9>

The printing portion 9 has recording heads in the form of four printing heads 25, and a platen 27 disposed in opposition to the printing heads 25, for supporting the paper sheet P.

The four printing heads 25 are configured to eject respective black, magenta, cyan and yellow inks IK. Each of the printing heads 25 takes the form of a generally rectangular parallelepiped which is elongate in a primary scanning direction D. Namely, the present ink-jet printer 1 is a line printer. Each printing head 25 has a lower ink-ejecting surface 26 in which a plurality of nozzles (not shown) are open. The ink-ejecting surface 26 has a length in the primary scanning direction D slightly larger than the largest width of the paper sheet P that can be fed from the sheet cassette 19, so that an image can be printed over the entire area of the paper sheet P. The four printing heads 25 are supplied with the respective inks IK of different colors from respective ink cartridges 28 described below, and eject droplets of these respective inks IK from the plurality of nozzles, whereby a desired image is formed by the droplets of the inks IK ejected from the ink-ejecting surfaces 26 of the printing heads 25, on the paper sheet P opposed to the printing heads 25, more specifically, on one of the opposite surfaces of the paper sheet P which is opposed to the printing heads 25. The above-indicated one surface is referred to as a "printing surface" of the paper sheet P.

In the present embodiment, the above-described primary scanning direction D is parallel to the horizontal plane and is perpendicular to a feeding direction C of the paper sheet P along the sheet feeding path, while an auxiliary scanning direction E is perpendicular to the primary scanning direction and is parallel to the sheet feeding direction C.

The ink IK ejected by each printing head 25 is a water-soluble ink aqueous components of which are vaporized when the ink IK is heated. That is, when the paper sheet P on which an image has been printed by the printing heads 25 is heated by the heating portion 13 described below, the aqueous components of the inks IK deposited on the paper sheet P are vaporized, so that the paper sheet P is efficiently dried.

The platen 27 is disposed below the printing heads 25, in opposition to the ink-ejecting surfaces 26 of the printing heads 25, and extends in both of the primary scanning direction D and the auxiliary scanning direction E. The platen 27 supports on its upper surface the paper sheet P during a printing operation on the paper sheet P, such that the paper sheet P is kept substantially parallel to the horizontal plane. The upper surface of the platen 27 is spaced downwards from the ink-ejecting surfaces 26 of the printing heads 25, and the paper sheet P is fed between the upper surface of the platen 27 and the ink-ejecting surfaces 26 of the printing heads 25.

<Sheet Feeding Portion 11/

The sheet feeding portion 11 has the above-indicated sheet guide 29, another sheet guide 31, two feed roller pairs 33, 35, and a sheet sensor 37 configured to detect the paper sheet P. The sheet feeding portion 11 is provided to feed the paper sheet P from the sheet supply unit 7 to the heating portion 13 through the printing portion 9.

The sheet guide 29 is disposed downstream of the sheet supply unit 7 and upstream of the printing portion 9, in the sheet feeding direction C. The sheet guide 29 is provided to guide the paper sheet P so that the paper sheet P is fed from the sheet supply unit 7 toward the printing portion 9. The sheet guide 31 is disposed downstream of the printing portion 9 and upstream of the heating portion 13, in the sheet feeding direction C. The sheet guide 31 is provided to guide the paper sheet P so that the paper sheet P is fed from the printing portion 9 toward the heating portion 13.

The feed roller pair 33 is disposed partway through the sheet guide 29, namely, downstream of the sheet supply unit 7 and upstream of the printing portion 9, in the sheet feeding direction C. The feed roller pair 33 consists of a driving roller and a driven roller. The driving roller is connected to and rotated by a sheet feeding motor 39 (shown in FIG. 6), while the driven roller is held in pressing contact with the driving roller and rotated by the driving roller. The feed roller pair 33 is provided to feed the paper sheet P delivered from the sheet supply unit 7, toward the printing portion 9, with a rotary motion of the driving roller, while the paper sheet P is nipped by and between the driving and driven rollers.

The feed roller pair 35 is disposed partway through the sheet guide 31, namely, downstream of the printing portion 9 and upstream of the heating portion 13, in the sheet feeding direction C. Like the feed roller pair 33, the feed roller pair 35 consists of a driving roller and a driven roller. The driving roller is connected to the sheet feeding motor 39. As shown in FIG. 1, the feed roller pair 35 is disposed such that the driven roller is opposed to the printing surface of the paper sheet P. The driven roller is a spur wheel, which does not damage the image printed on the paper sheet P. The feed roller pair 35 is provided to feed the paper sheet P received from the printing portion 9, toward the heating portion 13, while the paper sheet P is nipped by and between the driving and driven rollers.

The sheet sensor 37 is disposed partway through the sheet guide 29, downstream of the feed roller pair 33 and upstream of the printing portion 9. The sheet sensor 37 is provided to detect the paper sheet P being fed while being guided by the sheet guide 29.

<Heating Portion 13>

Figure 2:
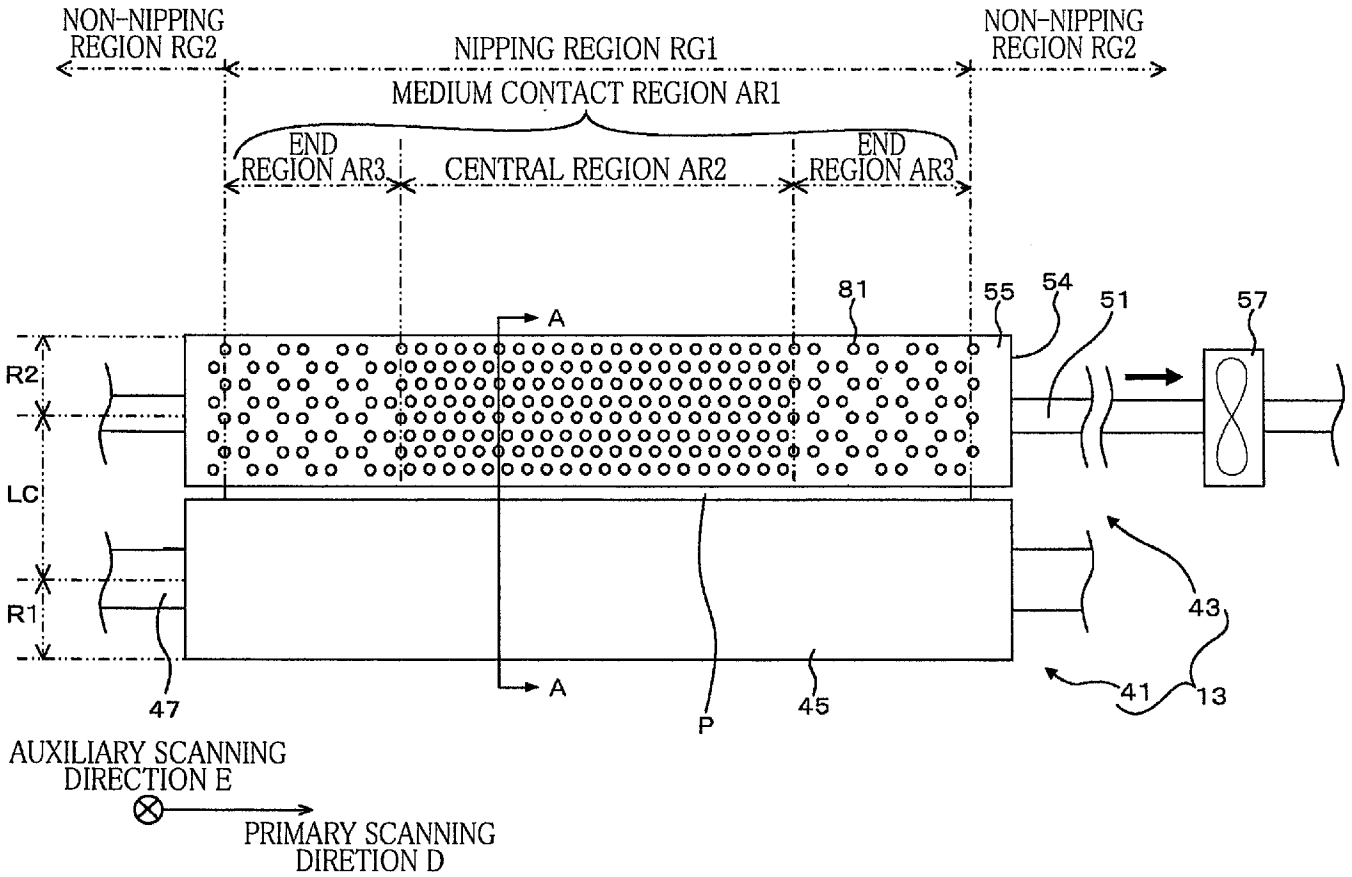
FIG. 2 is a schematic side elevational view of a heating portion constructed according to the first embodiment of the invention.

The heating portion 13 has a first nipping member 41 and a second nipping member 43. As shown in FIG. 2, the first and second nipping members 41, 43 are rotatable rollers extending in the primary scanning direction D and disposed such that the first and second nipping members 41, 43 are opposed to each other. The heating portion 13 is provided to heat the paper sheet P being nipped by and between the first and second nipping members 41, 43, and to further feed the paper sheet P fed by the sheet feeding portion 11, in the sheet feeding direction C.

As shown in FIG. 1, the first nipping member 41 is disposed in opposition to the surface of the paper sheet P opposite to the printing surface. Namely, when the paper sheet P is nipped by the first and second nipping members 41, 43, the first nipping member 41 is held in contact with the surface of the paper sheet P opposite to the printing surface. On the other hand, the second nipping member 43 is disposed in opposition to the printing surface of the paper sheet P. Namely, when the paper sheet P is nipped by the first and second nipping members 41, 43, the second nipping member 43 is held in contact with the printing surface of the paper sheet P.

Figure 3:
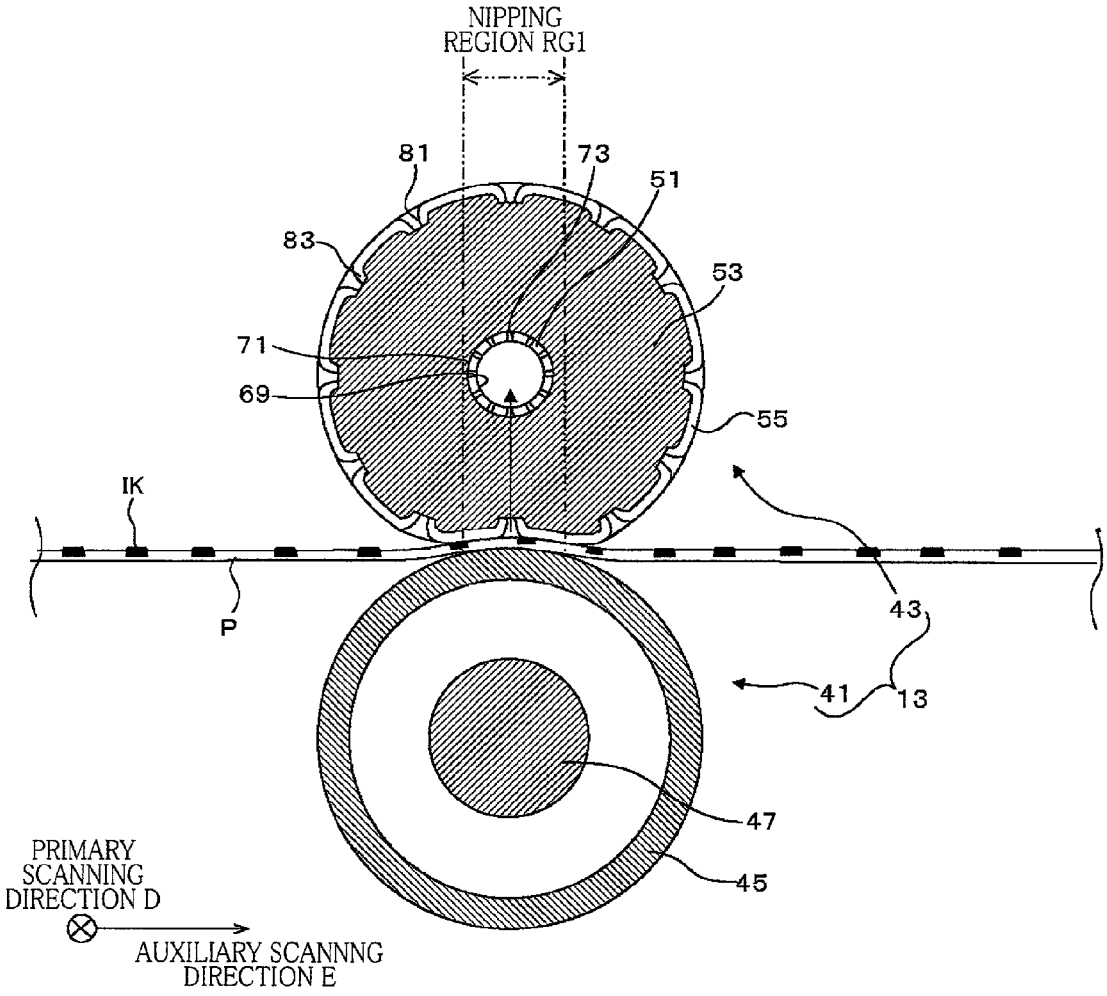
FIG. 3 is a cross sectional view taken along line A-A in FIG. 1, showing a first nipping member and a second nipping member constructed according to the first embodiment, while a paper sheet is nipped by and between the first and second nipping members.

A region in which the first and second nipping members 41, 43 contact the paper sheet P to nip it therebetween is referred to as a "nipping region RG1". In the nipping region RG1 of the first and second nipping members 41, 43, these nipping members 41, 43 disposed in opposition to each other contact the paper sheet P. As indicated in FIGS. 2 and 3, the nipping region RG1 extend in both of the primary scanning direction D and the auxiliary scanning direction E. As indicated in FIG. 2, the length and position of the nipping region RG1 in the primary scanning direction D correspond to the width and position of the paper sheet P in the primary scanning direction. Described more specifically, the length and position of the nipping region RG1 are identical with the width and position of the paper sheet P in the primary scanning direction D. It is noted that the length and position of the nipping region RG1 in the primary scanning direction D correspond to the width and position of the paper sheet P of the largest size that can be fed through the ink-jet printer 1. Regions which are located outwardly of the nipping region RG1 in the primary scanning direction D and in which the first and second nipping members 41, 43 do not contact the paper sheet P are referred to as "non-nipping regions RG2". The length and position of the nipping region RG2 in the auxiliary scanning direction will be described below.

The first and second nipping members 41, 43 are examples of two nipping members, and the second nipping member 43 is an example of one of the two nipping members.

As shown in FIG. 3, the first nipping member 41 has a cylindrical member 45 and a heater 47. The cylindrical member 45 is a metallic member having an inner hollow space, and extends in the primary scanning direction D, as shown in FIG. 2. The cylindrical member 45 has a length in the primary scanning direction D, which is larger than the length of the nipping region RG1, so that the cylindrical member 45 contacts the paper sheet P over its entire width while the paper sheet P is nipped by and between the first and second nipping members 41 43. As shown in FIG. 3, there is disposed the heater 47 within the inner hollow space of the cylindrical member 45. The cylindrical member 45 is heated with a heat generated by the heater 47 energized under the control of the control portion 100. The cylindrical member 45 is connected to and rotated by the sheet feeding motor 39 (shown in FIG. 6).

The second nipping member 43 has a sleeve member 51, an elastic member 53 having an air-permeable property, a film 55 having a liquid-repellant property, and a sucker fan 57 (shown in FIG. 2).

The sleeve member 51 is a cylindrical metallic member having an inner circumferential surface 69 defining the above-indicated inner hollow space. As shown in FIG. 2, the sleeve member 51 extends in the primary scanning direction D, and has a length in the primary scanning direction D, which is larger than the length of the nipping region RG1. As shown in FIG. 3, the sleeve member 51 has a plurality of vent holes 73 formed so as to extend between an outer circumferential surface 71 and the above-indicated inner circumferential surface 69. The vent holes 73 are formed in the nipping region RG1. An outer annular space defined by the outer circumferential surface 71 and the inner hollow space defined by the inner circumferential surface 69 communicate with each other through the plurality of vent holes 73.

The elastic member 53 is an annular member disposed radially externally of the outer circumferential surface 71 of the sleeve member 51. The elastic member 53 is disposed such that its outer circumferential surface is opposed to the first nipping member 41, and extends in the primary scanning direction D, having a length in the primary scanning direction D, which is larger than that of the nipping region RG1. The outer circumferential surface of the elastic member 53 is held in opposition to the paper sheet P, in its region corresponding to the nipping region RG1, when the paper sheet P is nipped by and between the first and second nipping members 41, 43. In the region corresponding to the non-nipping regions RG2, the outer circumferential surface of the elastic member 53 is not in opposition to the paper sheet P when the paper sheet P is nipped by and between the first and second nipping members 41, 43. As shown in FIG. 2, the elastic member 53 has opposite end faces 54 which are perpendicular to the primary scanning direction D and which are located in the non-nipping regions RG2.

The elastic member 53 is formed of a spongy material of an elastic porous structure having air-permeability. The elastic member 53 does not have a liquid-repellant property. The elastic member 53 is preferably formed of a rubber material, more preferably, a silicone rubber, an urethane rubber, a nitrile rubber, an ethylene rubber or a propylene rubber. However, the material of the elastic member 53 is not limited to the rubber materials indicated above, and may be any elastic material having an air-permeable property.

The film 55 is a thin film having a liquid-repellant property, which covers the outer circumferential surface of the elastic member 53. As shown in FIG. 3, the film 55 extends in the primary scanning direction D, and has a length in the primary scanning direction D, which is larger than the length of the nipping region RG1 and is substantially equal to the length of the elastic member 53 in the primary scanning direction D. The film 55 covers a length portion of the outer circumferential surface of the elastic member 53 which corresponds to the nipping region RG1. The film 55 does not cover the end faces 54 of the elastic member 53. Namely, the end faces 54 of the elastic member 53 are not covered by the film 55, but are exposed to the atmosphere.

The film 55 has a medium contact region AR1 in which the film 55 contacts the paper sheet P being nipped by and between the first and second nipping members 41, 43. This medium contact region AR1 has a length and a position in the primary scanning direction D, which correspond to those of the nipping region RG1. Described more specifically, the length and position of the medium contact region AR1 in the primary scanning direction D are identical with those of the nipping region RG1 in the primary scanning direction D. The length of the medium contact region AR in the primary scanning direction D may be larger than the length of the nipping region RG1 in the primary scanning direction D. As shown in FIG. 2, the film 55 has a plurality of through-holes 81 formed in the medium contact region AR1. The plurality of through-holes 81 are arranged in a zigzag pattern, so that the through-holes 81 are formed with a relatively high degree of density per unit area of the circumferential surface of the film 55. The medium contact region AR1 consists of a central region AR2 located in a central part of the film 55 in the primary scanning direction D, and end regions AR3 located outwardly of the central region AR2 in the primary scanning direction D. The through-holes 81 are formed in the central region AR2, with a higher degree of density, than in the end regions AR3. Namely, the number of the through-holes 81 formed in the central region AR2 per unit area is larger than in the end regions AR3.

Figure 4:
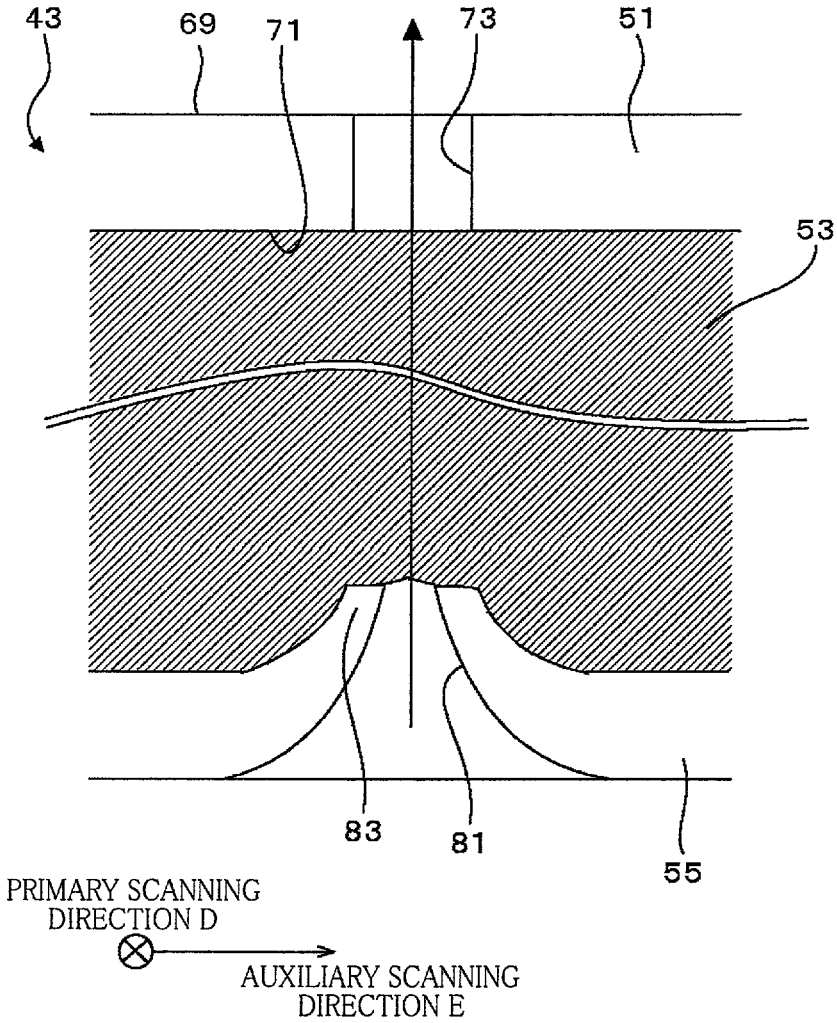
FIG. 4 is an enlarged fragmentary cross sectional view of the second nipping member according to the first embodiment.
Figure 5:
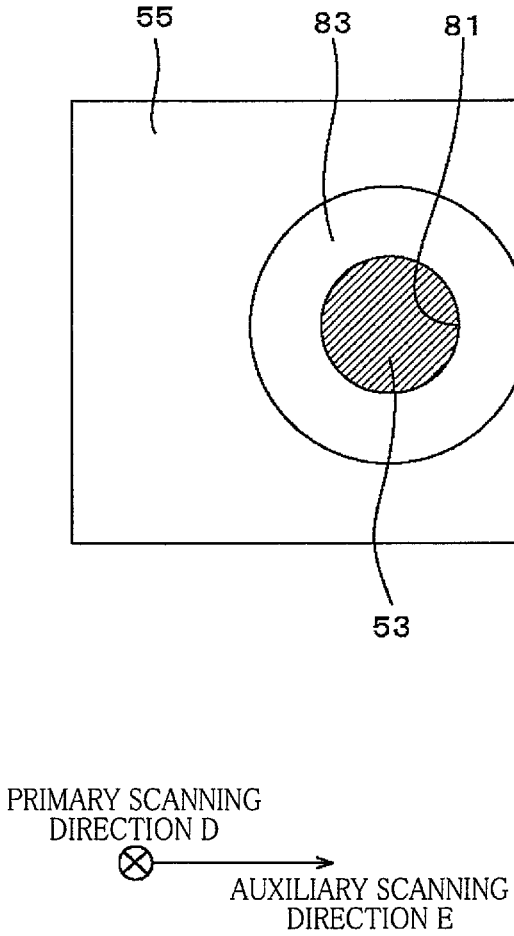
FIG. 5 is an enlarged fragmentary cross sectional view of the second nipping member according to the first embodiment.

As shown in FIGS. 4 and 5, the film 55 has raised portions 83 through which the respective through-holes 81 are formed. The raised portions 83 protrude toward the elastic member 53 radially inwardly of the elastic member 53. Each of the raised portions 83 has a generally triangular pyramidal shape with its inner end section embedded in the elastic member 53. Each of the through-holes 81 has an inner end portion formed through the corresponding pyramidal raised portion 83, and has a diameter which decreases as the through-hole 81 extends radially inwardly of the elastic member 53. A portion of the elastic member 53 in which the raised portion 83 is embedded is elastically compressed radially inwardly of the elastic member 53, so that the radially inwardly compressed portion is less likely to be exposed through the through-hole 81 to the inks IK on the paper sheet P, than where the film 55 is not provided with the raised portions 83.

The film 55 is preferably formed of a fluororesin, more preferably, polytetrafluoroethylene, perfluoroalkoxy resin, ethylene propylene fluoride resin, polyvinylidene fluoride, or ethylene-tetrafluoroethylene copolymer. The material of the film 55 is not limited to those indicated above by way of example, and the film 55 may be formed of any other material having a liquid-repellant property. The film 55 has a heat-resistant property so that the film 55 will not be melted due to heat generated by the heater 47.

The first and second nipping members 41, 43 as installed in the ink-jet printer 1 have a center-to-center distance LC (indicated in FIG. 2), which is smaller than a sum of a radius R1 of the first nipping member 41 and a radius R2 of the second nipping member 43 prior to the installation. Namely, the first and second nipping members 41, 43 are pressed against each other, so that the elastic member 53 and the film 55 of the second nipping member 43 are elastically compressed in the radially inward direction, as shown in FIG. 3, so that the nipping region RG1 is enlarged in the auxiliary scanning direction E, as also shown in FIG. 3. That is, the dimension of the nipping region RG1 in the auxiliary scanning direction E is determined by amounts of elastic deformation of the elastic member 53 and film 55 of the second nipping member 43. The paper sheet P is nipped by and between the first and second nipping members 41, 43 which are held in pressing contact with each other with elastic deformation or compression of the elastic member 53 and film 55

The sucker fan 57 is mounted on an end portion of the sleeve member 51 which is located in one of the two non-nipping regions RG2 and which is spaced from the end face 54 of the elastic member 53 in the primary scanning direction D. The sucker fan 57 is operated under the control of the control portion 100, to cause an air flow as indicated by a thick arrow-headed line in FIG. 2. Described more specifically, the sucker fan 57 sucks the air within the inner hollow space defined by the inner circumferential surface 69 of the sleeve member 51, for thereby evaluating the inner hollow space. In this connection, it is noted that the sleeve member 51 has the vent holes 73 formed for communication between the inner hollow space defined by the inner circumferential surface 69 and the outer annular space defined by the outer circumferential surface 71, as shown in FIG. 4, and that the outer circumferential surface 71 is covered by the air-permeable elastic member 53, while the outer circumferential surface of the elastic member 53 is covered by the film 55 having the plurality of through-holes 81, as also shown in FIG. 4. Accordingly, the air sucking operation of the sucker fan 57 causes the air flow indicated by an arrow-headed line in FIG. 4. Described more particularly, the air flows from the external space outside the second nipping member 43, into the elastic member 53 through the through-holes 81, and from the elastic member 53 into the inner hollow space defined by the inner circumferential surface 69, through the vent holes 73. As a result, the vapor generated from the paper sheet P being nipped between the first and second nipping members 41, 43 escapes into the elastic member 53 through the through-holes 81, and from the elastic member 53 into the inner hollow space of the sleeve member 51 through the vent holes 73.

<Sheet Ejecting Portion 15>

As shown in FIG. 1, the sheet ejecting portion 15 has a sheet guide 59 for guiding the paper sheet P, and two feed roller pairs 61 for feeding the paper sheet P. The sheet guide 59 is disposed downstream of the heating portion 13 and upstream of the sheet receiver tray 5, in the sheet feeding direction C. The sheet guide 59 is configured to guide the paper sheet P from the heating portion 13 toward the sheet receiver tray 5. The two feed roller pairs 61 are disposed downstream of the heating portion 13 and upstream of the sheet receiver tray 5, in the sheet feeding direction C. One of the two feed roller pairs 61 is disposed partway through the sheet guide 59, while the other feed roller pair 61 is disposed downstream of the sheet guide 59, in the sheet feeding direction C. Each of the feed roller pairs 61 consists of a driving roller connected to and rotated by the sheet feeding motor 39 (shown in FIG. 6), and driven roller held in pressing contact with the driving roller. The feed roller pairs 61 are provided to further feed the paper sheet P fed by the heating portion 13, toward the sheet receiver tray 5, with rotary motions of the driving rollers.

<Cartridge Unit 17>

The cartridge unit 17 is disposed in a lower part of the housing 3. The cartridge unit 17 has a cartridge tray 85 for accommodating four ink cartridges 28 which are charged with the respective black, magenta, cyan and yellow inks and from which the inks are supplied to the respective printing heads 25.

<Control Portion 100>

Figure 6:
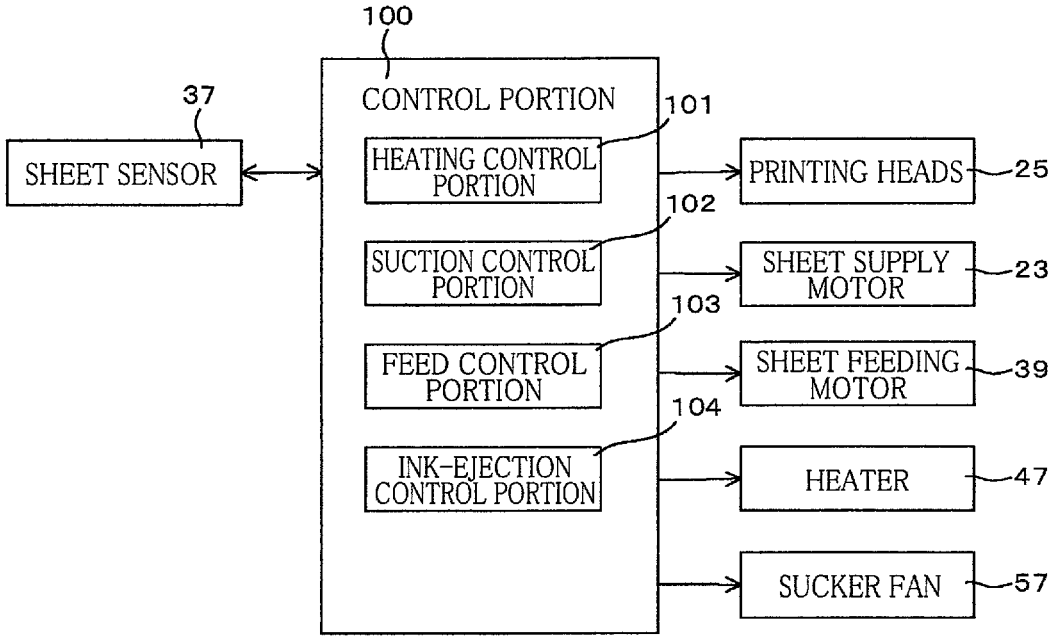
FIG. 6 is a block diagram showing a control system of the ink-jet printer according to the first embodiment.

An electric arrangement of the ink-jet printer 1 will then be described by reference to the block diagram of FIG. 6. The control device 100 is constituted by a processing device in the form of a CPU (central processing unit) not shown, and a plurality of hardware components including a ROM (read-only memory) not shown, and a RAM (random-access memory) not shown. The ROM stores control programs executed by the CPU, and various kinds of fixed data. The RAM is provided to temporarily store data (e.g., image data) required to execute the control programs. The control programs and the hardware components of the control device 100 cooperate to constitute a heating control portion 101, a suction control portion 102, a feed control portion 103 and an ink-ejection control portion 104. The control device 100 has other control portions configured to perform various processing operations.

The heating control portion 101 controls the heater 47. When the heater 47 is energized under the control of the heating control portion 101, the cylindrical member 45 of the first nipping member 41 is heated, so that the paper sheet P nipped by and between the first and second nipping members 41, 43 is heated.

The suction control portion 102 controls the operation of the sucker fan 57. When the sucker fan 57 is operated under the control of the suction control portion 102, the air in the inner hollow space within the inner circumferential surface 69 of the sleeve member 51 is sucked to thereby evacuate the inner hollow space, so that the air flows from the external space into the inner hollow space through the through-holes 81, elastic member 53 and vent holes 73. It will be understood that the sucker fan 57 and the suction control portion 102 cooperate to constitute an example of sucking means of a drying apparatus.

The feed control portion 103 controls the sheet supply motor 23 and the sheet feeding motor 39, to feed the paper sheet P from the sheet supply cassette 19 along the sheet feeding path.

The ink-ejection control portion 104 controls the printing heads 25, to eject the droplets of the inks IK from the ink-ejecting surfaces 26 of the printing heads 25.

It will be understood that the heating portion 13, heating control portion 101 and suction control portion 102 cooperate to constitute an example of the drying apparatus.

<Printing Operation>

A printing operation of the present ink-jet printer 1 will be described next.

When image data representative of an image to be printed on the paper sheet P are transmitted from an external device such as a PC (personal computer) to the control portion 100, the heating control portion 101 energizes the heater 47 such that the heater 47 is heated to a predetermined temperature at which the drying of the paper sheet P is promoted. The predetermined temperature is preferably selected within a range of 50-150° C., more preferably, within a range of 90-120° C. The predetermined temperature need not exceed the boiling point of water, and may be suitably selected to promote the drying of the paper sheet P.

The suction control portion 100 activates the sucker fan 57 to suck the air within the inner hollow space of the sleeve member 51.

The feed control portion 103 activates the sheet feeding motor 23 to rotate the sheet supply roller 21 so that the paper sheet P is delivered from the sheet supply cassette 19 toward the sheet feeding portion 11. The feed control portion 103 then activates the sheet feeding motor 39 to rotate the driving rollers of the feed roller pairs 33, 35, the first nipping member 41 of the heating portion 13, and the driving rollers of the two feed roller pairs 61. The paper sheet P delivered by the sheet supply roller 21 is fed by the feed roller pair 33 while being nipped by the feed roller pair 33, and passed under the printing portion 9. The paper sheet P on which an image has been printed by the printing portion 9 is further fed by the feed roller pair 35 while being nipped by the feed roller pair 35, so that the paper sheet P is then fed by the first and second nipping members 41, 43 while being nipped by these nipping members 41, 43. The paper sheet P fed by the first and second nipping members 41, 43 is further fed by the feed roller pairs 61 while being nipped by the feed roller pairs 61, so that the paper sheet P is ejected onto the sheet receiver tray 5. Thus, the paper sheet P is fed from the sheet feeding portion 11 to the sheet receiver tray 5 through the printing portion 9, heating portion 13 and sheet ejecting portion 15, by the sheet supply motor 23 and sheet feeding motor 39 controlled by the feed control portion 103.

The ink-ejection control portion 104 controls the printing heads 25 to eject the droplets of the inks IK from the ink-ejecting surfaces 26 onto the paper sheet P being fed along the sheet feeding path. Described more specifically, the ink-ejection control portion 104 controls the printing heads 25 to initiate the ejection of the droplets of the inks IK from the ink-ejecting surfaces 26, at predetermined different points of time after the moment of detection of the paper sheet P by the sheet sensor 37, at which a leading edge of a predetermined printing area of the paper sheet P is expected to pass right under the respective ink-ejecting surfaces 26. The time periods from the moment of detection of the paper sheet P by the sheet sensor 37 to the above-indicated different points of time are obtained by dividing the distances between the position of the sheet sensor 37 and the positions of the ink-ejecting surfaces 26 of the printing heads 25, by the feeding speed of the paper sheet P. The ink-ejection control portion 104 controls the printing heads 25 on the basis of the image data stored in the RAM, to print the image on the printing surface of the paper sheet P.

Then, effects of heating by the heating portion 13 and the air suction by the sucker fan 57 will be described. As shown in FIG. 3, the droplets of the inks IK ejected from the printing heads 25 so as to form an image are deposited on the printing surface of the paper sheet P being fed by and nipped between the first and second nipping members 41, 43 such that the first nipping member 41 is in contact with the surface of the paper sheet P opposite to the printing surface while the second nipping member 43 is in contact with the printing surface of the paper sheet P. The first and second nipping members 41, 43 contact the paper sheet P in the nipping region RG1. More specifically, the cylindrical member 45 of the first nipping member 41 and the film 55 of the second nipping member 53 contact the paper sheet P in the nipping region RG1.

While the paper sheet P is fed by and nipped between the first and second nipping members 41, 43, the cylindrical member 45 of the first nipping member 41 is heated with the heat generated by the heater 47, so that the paper sheet P is heated by the first nipping member 41. As a result, the aqueous components of the inks IK ejected from the printing heads 25 onto the paper sheet P are vaporized by the heated first nipping member 41, with a result of generation of a vapor (steam). Namely, the heat is conducted from the first nipping member 41 to the surface of the paper sheet P opposite to the printing surface, and then conducted to the printing surface, causing vaporization of the aqueous components of the inks IK deposited on the printing surface, and consequent generation of a vapor. The vapor generated from the paper sheet P can escape into the elastic member 53 through the plurality of through-holes 81 formed through the film 55 of the second nipping member 43 in contact with the paper sheet P, as shown in FIG. 4.

As shown in FIG. 2, the end faces of the elastic member 53 are not covered by the film 55 and are exposed to the atmosphere, so that the vapor can escape from the elastic member 53 into the atmosphere through the end faces 54.

At the same time, the air within the inner hollow space defined by the inner circumferential surface 69 of the sleeve member 51 of the second nipping member 43 is sucked by the sucker fan 57, so that the inner hollow space is evacuated, whereby the vapor generated from the paper sheet P nipped by the first and second nipping members 41, 43 and heated by the first nipping member 41 can escape from the paper sheet P into the inner hollow space in the sleeve member 51, through the through-holes 81, elastic member 53 and vent holes 73, owing to the air suction by the sucker fan 57. In other words, the vapor which can escape from the paper sheet P through the through-holes 81 will not substantially stay in the nipping region RG1 of the first and second nipping members 41 43, so that the inks IK deposited on the paper sheet P can be rapidly dried.

As shown in FIG. 4 and as described above, the film 55 has the raised portions 83 which protrude radially inwardly of the elastic member 53 and through which the through-holes 81 are formed. The portion of the elastic member 53 in which each raised portion 83 is embedded is elastically compressed radially inwardly of the elastic member 53, so that the radially inwardly compressed portion is less likely to be exposed through the through-hole 81 to the inks IK on the paper sheet P, than where the film 55 is not provided with the raised portions 83. Namely, a distance between each radially inwardly compressed portion of the elastic member 53 and the printing surface of the paper sheet P is increased in the presence of the raised portions 83 of the film 5, so that a risk of exposure of the elastic member 53 through the through-holes 81 to the inks IK on the printing surface of the paper sheet P is effectively reduced, whereby the elastic member 53 is protected from contacting the inks IK and contamination with the inks IK. Accordingly, a risk of contamination of the paper sheet P with the inks IK transferred from the elastic member 53 is prevented during a printing operation on the paper sheet P while the paper sheet P is in contact with the second nipping member 43. Even if the elastic member 53 is contaminated with the inks IK transferred from the paper sheet P through the through-holes 81, the paper sheet P is not likely to be contaminated with the inks IK transferred from the elastic member 53 during the printing operation, owing to a relatively large distance between the radially inwardly compressed portions of the elastic member 53 and the printing surface of the paper sheet P in the presence of the raised portions 83 of the film 55. In this connection, it is noted that the film 55 of the second nipping member 43 which contacts the printing surface of the paper sheet P is not likely to be contaminated with the inks IK, since the film 55 has a liquid-repellant property, as described above.

As described above, the through-holes 81 are formed in the central region AR2 of the film 55, with a higher degree of density, than in the end regions AR3 of the film 55, in view of a prior art tendency that the vapor generated from the paper sheet P is more likely to stay in the central region AR2 of the film 55, than in the end regions AR3 of the film 55. Accordingly, the vapor generated from the paper sheet P in the central region AR3 can easily and efficiently escape through the through-holes 81 formed in the central region AR2 with the higher degree of density. The vapor reaching the elastic member 53 through the through-holes 81 formed in the central region AR2 of the film 55 is sucked into the inner hollow space formed within the inner circumferential surface 69 of the sleeve member 51. Thus, the inks IK deposited in the area of the paper sheet P opposed to the central region AR2 of the film 55 can be rapidly and efficiently dried. Similarly, the vapor generated from the paper sheet P in the end regions AR3 of the film 55 can escape through the through-holes 81 formed in the end regions AR3, and the vapor reaching the elastic member 53 through the through-holes 81 is sucked into the inner hollow space in the sleeve member 51, and can escape into the atmosphere through the inner hollow space and the end faces 54 of the elastic member 53. Thus, the inks IK deposited in the areas of the paper sheet P opposed to the end regions AR3 of the film 55 can be rapidly and efficiently dried.

In the end regions AR3 of the film 55, the density of formation of the though-holes 81 is lower than in the central region AR2, so that the risk of exposure of the elastic member 53 through the through-holes 81 to the inks IP on the paper sheet P is lower in the end regions AR3 than in the central region AR2, and the risk of contamination of the elastic member 53 with the inks IK transferred from the paper sheet P is accordingly reduced.

<Method of Fabricating Second Nipping Member 43>

Figure 7:
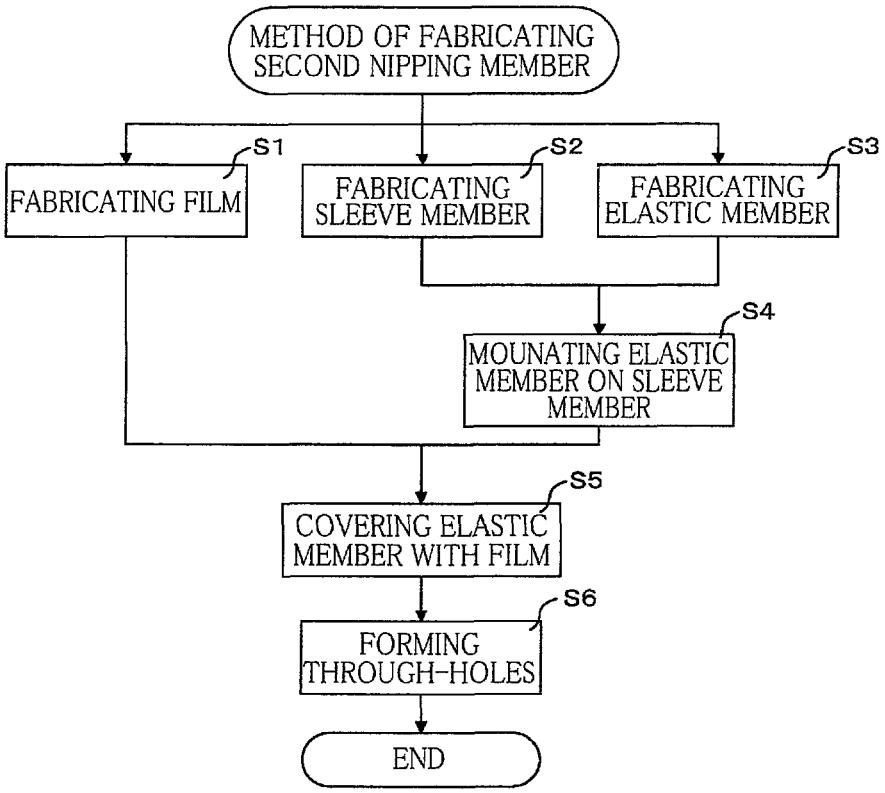
FIG. 7 is a flow chart illustrating a method of fabricating the second nipping member according to the first embodiment.

Then, the method of fabricating the second nipping member 43 will be described by reference to FIG. 7.

Initially, the film 55, sleeve member 51 and elastic member 53 are fabricated independently of each other, in steps S1, S2 and S3, which may be implemented one after another or concurrently with each other.

Step S1 is implemented to fabricate the liquid-repellant film 55. Then, step S2 is implemented to fabricate the elastic member 51 having the inner circumferential surface 69 defining the inner hollow space. The elastic member 51 has the plurality of through-holes 73 formed to extend between the inner and outer circumferential surfaces 69 and 71. Step S3 is implemented to fabricate the air-permeable elastic member 53.

Step S4 is then implemented to mount the elastic member 53 fabricated in step S3, on the sleeve member 51 fabricated in step S2, such that a longitudinal portion of the outer circumferential surface 71 of the sleeve member 51 which corresponds to the nipping region RG1 is covered by the elastic member 53. Thus, a precursor of the second nipping member 43 is manufactured.

Step S5 is then implemented to cover the outer circumferential surface of the elastic member 53 of a precursor of the second nipping member 43 fabricated in step S4, with the film 55. The precursor of the second nipping member 43 is interpreted to mean a structure which consists of the sleeve 51 and the elastic member 53 mounted thereon and which does not include the film 55 that covers the elastic member 53 to eventually fabricate the second nipping member 43. In step S5, the outer circumferential surface of the elastic member 53 of the precursor of the second nipping member 43 fabricated in step S4 is coated with an adhesive agent, and then the film 55 is bonded to the outer circumferential surface of the elastic member 53 with the adhesive agent, such that the longitudinal portion of the outer circumferential surface of the elastic member 53 which corresponds to the nipping region RG1 is covered by the film 55. Step S5 is an example of a covering step in the method of fabricating a nipping member.

Figure 8:
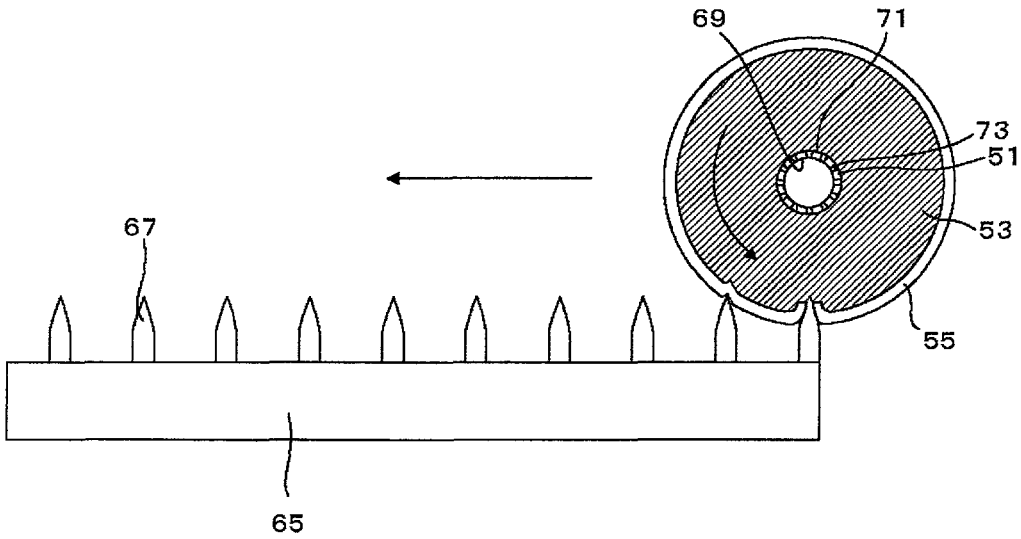
FIG. 8 is a view showing a through-hole forming step in the method of fabricating the second nipping member according to the first embodiment.

Step S6 is then implemented to form the through-holes 81 through the film 55 bonded in step S5 to the precursor of the second nipping member 43. In step S6, the precursor of the second nipping member 43 with the film 55 bonded thereto in step S5 is moved relative to a base 65 provided with a plurality of needle members 67 fixed thereto, in a direction indicated by an arrow-headed line in FIG. 8, while the precursor is rotated, so that the film 55 is pierced with the plurality of needle members 67, whereby the plurality of through-holes 81 are formed through the film 55, in a zigzag pattern corresponding to a zigzag arrangement of the needle members 67 on the base 65, as shown in FIG. 2. Step S6 is an example of a step of forming through-holes in the method of fabricating the nipping member.

Step S6 of forming the through-holes 81 will be described in detail by reference to FIG. 9.

Figure 9:
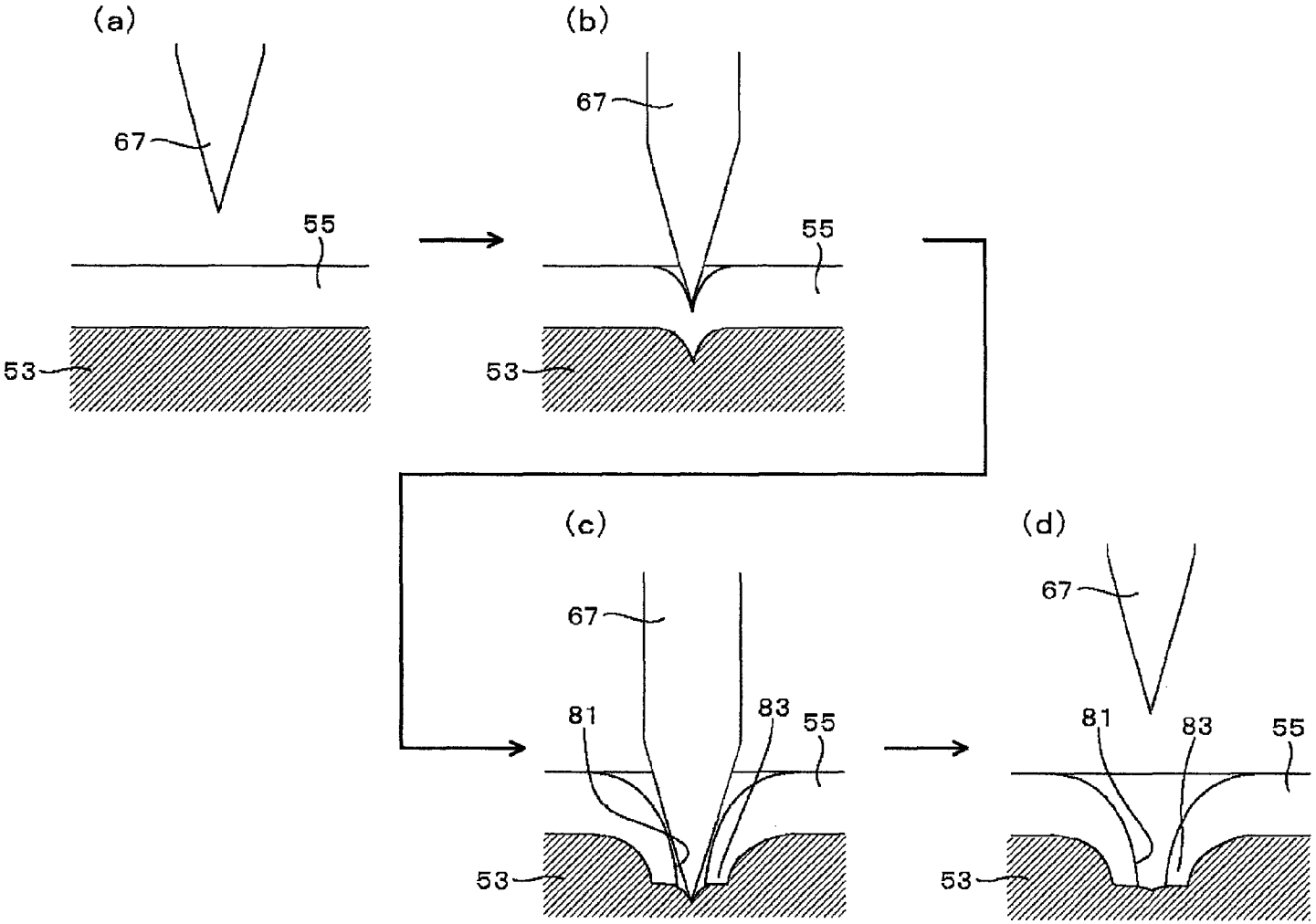
FIG. 9 is a view showing detailed operations sequentially performed in the through-hole forming step of the through-hole forming step according to the first embodiment.

Initially, the film 55 covering the elastic member 53 is spaced apart from a given one of the needle members 67, as indicated at (a) in FIG. 9.

Then, the needle member 67 comes into contact with the film 55, as indicated at (b) in FIG. 9. When the film 55 is pressed by the needle member 67, a pressed portion of the film 55 is plastically deformed radially inwardly toward the elastic member 53. At this time, the plastically deformed portion of the film 55 is not yet provided with the through-hole 81, and a portion of the elastic member 53 corresponding to the plastically deformed portion of the film 55 is elastically compressed radially inwardly by the plastically deformed portion.

When the film 55 is further pressed by the needle member 67, the film 55 is provided with the through-hole 81, as indicated at (c) in FIG. 9. At this time, a portion of the film 55 through which the through-hole 81 is formed is further plastically deformed by a further pressing force transferred from the needle member 67, whereby the radially inwardly raised portion 83 is formed, and the portion of the elastic member 53 corresponding to the raised portion 83 through which the through-hole 81 is formed is further elastically compressed radially inwardly by the raised portion 83. Further, the needle member 67 has pierced the layer of the adhesive agent covering the outer circumferential surface of the elastic member 53, so that the vapor generated from the paper sheet P can escape into the elastic member 53 through the through-hole 81.

Then, the needle member 67 is moved away from the film 55, as indicated at (d) in FIG. 9, but the portion of the film 55 which has been plastically deformed by the needle member 67 remains as the raised portion 83 which protrudes radially inwardly toward the elastic member 53 and which partially defines the through-hole 81 is formed, and the corresponding portion of the elastic member 53 is kept elastically compressed radially inwardly by the raised portion 83 having the through-hole 81. Accordingly, the radially inwardly compressed portion of the elastic member 53 is not likely to be exposed to the inks IK on the paper sheet P, through the through-hole 81, whereby the radially inwardly compressed portion is protected from contacting the inks IK on the printing surface of the paper sheet P during the printing operation on the printing surface in contact with the film 55.

Modifications of First Embodiment

The paper sheet P may be an ordinary paper, a cardboard, a postcard and a name card. Further, the paper sheet P may be replaced by any other recording medium on which an image can be printed or recorded, for example, by a plastic sheet for an overhead projector (OHP), or a wood board.

The ink-jet printer 1 may be modified to permit printing on the opposite surfaces of a recording medium. For instance, the ink-jet printer 1 may be modified to have a mechanism configured to turn the paper sheet P upside down after the paper sheet P is received by the receiver tray 5, and to feed the paper sheet P back to the sheet feeding portion 11. In this case, the heating portion 13 need not be disposed upstream of the printing portion 9, and may be disposed downstream of the printing portion 9, in the sheet feeding direction C.

The printing heads 25 are not limited to the line printing type, and may be the serial printing type in which the printing heads eject the droplets of inks while the printing heads are reciprocated in the primary scanning direction D. The ink-jet printer 1 need not have the four printing heads 25, but may have a desired number of printing heads. Further, the four printing heads 25 corresponding to the respective four colors of inks IK may be replaced by printing heads used to eject a desired number of colors of the inks. The water soluble inks IK ejected by the printing heads 25 may be replaced by any other inks including a volatile liquid which is vaporized by heating.

The first and second nipping members may be disposed such that the first nipping member contacts the printing surface of the paper sheet P while the second nipping member contacts the surface opposite to the printing surface. Further, the heater 47 may be disposed within the second nipping member 43, rather than the first nipping member 41, and the sleeve member 51 may be disposed so as to extend through the inner space within the first nipping member 41 rather than the second nipping member 43.

The first and second nipping members 41, 43 in the form of rollers may be replaced by any other structural members which can nip and heat the paper sheet P or other recording medium. In other words, the first and second nipping members need not be configured to feed the paper sheet P or other recording medium. For instance, the first nipping member has a heater in the form of a plate, while the second nipping member has a member in the form of a plate, an elastic member having an air-permeable property, and a film having a liquid-repellant property. In this case, a surface of the plate of the second nipping member which is opposed to the first nipping member is covered by the elastic member, and a surface of the elastic member which is opposed to the first nipping member is covered by a film which has a plurality of through-holes. When the paper sheet P is nipped and heated by the first and second nipping members, a vapor generated from the paper sheet P can escape into the elastic member through the through-holes formed through the film, so that the paper sheet P can be rapidly dried.

The heater 47 may use a halogen lamp, a carbon heating element, a ceramic heating element or any other heating element.

The sucker fan 57 may be replaced by any other device such as a sucker pump, which is configured to evacuate the inner hollow space within the inner circumferential surface 69 of the sleeve member 51.

The second nipping member 43 rather than the first nipping member 41 may have the heater 43. Further, both of the first and second nipping members 41, 43 may have respective heaters.

The first nipping member 41 may have an elastic member having an air-permeable property, and a film having a liquid-repellant property, which covers the outer circumferential surface of the elastic member and which has a plurality of through-holes.

The film 55 may have through-holes formed in a region or regions outside the medium contact region AR1. Further, the through-holes formed in the central region AR2 and the through-holes formed in the end regions AR3 may have the same degree of density. Alternatively, the through-holes formed in the end regions AR3 have a higher degree of density than the through-holes formed in the central region AR2. The through-holes 81 formed through the film 55 need not be arranged in a zigzag pattern, and may be arranged in a matrix or in a random pattern.

The through-holes 81 need not be formed through the raised portions 83, and the raised portions 83 need not take the form of a triangular pyramid. For instance, the through-holes 81 may be formed through cylindrical raised portions having a larger thickness than the other portions of the film 55.

In the method of fabricating the second nipping member 43, the covering step S5 need not be followed by the through-hole forming step S6. The through-hole forming step may be followed by the covering step. In this case, the through-holes 81 are formed by piercing the needle members 67 into the film 55 in the direction from one of its opposite surfaces toward the other, and the outer circumferential surface of the elastic member 53 is covered by the film 55 in the covering step such that the above-indicated other surface of the film 55 is in contact with the outer circumferential surface of the elastic member 53.

In the through-hole forming step S6 according to the present embodiment, the needle members 67 are pierced into the film 55 to form the through-holes 81 through the film 55, while at the same time forming the raised portions 83 through which the through-holes 81 are formed. However, the present embodiment may be modified in connection with this through-hole forming step. For instance, a step of forming the raised portions 83 may be implemented independently of the step of forming the through-holes 81. Described more specifically, the plurality of through-holes 81 are initially formed through the film 55, and the needle members 67 are then inserted into the through-holes 81, and heated to elastically deform the portions of the film 55 around the through-holes 81, for thereby forming the raised portions 83.

Second Embodiment

Figure 10:
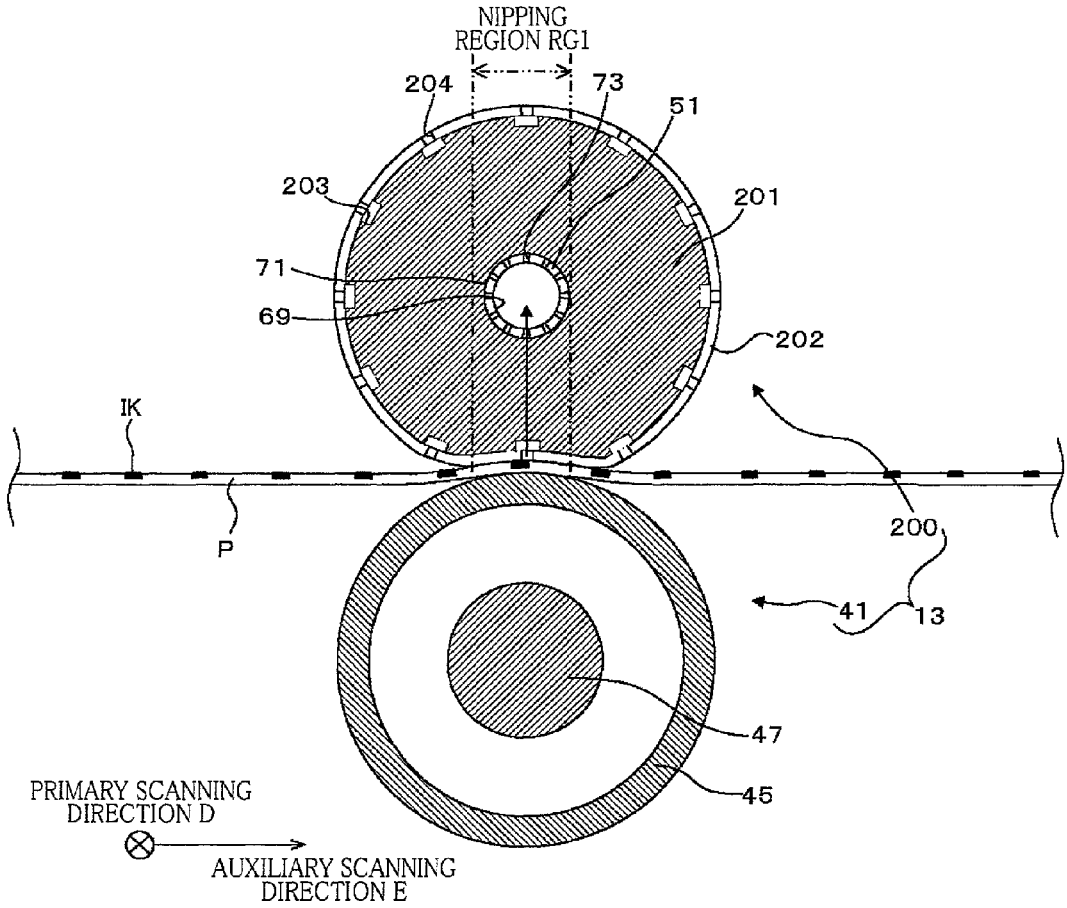
FIG. 10 is a cross sectional view of a heating portion constructed according to a second embodiment of this invention, showing a first nipping member and a second nipping member, while a paper sheet is nipped by and between the first and second nipping members.
Figure 11:
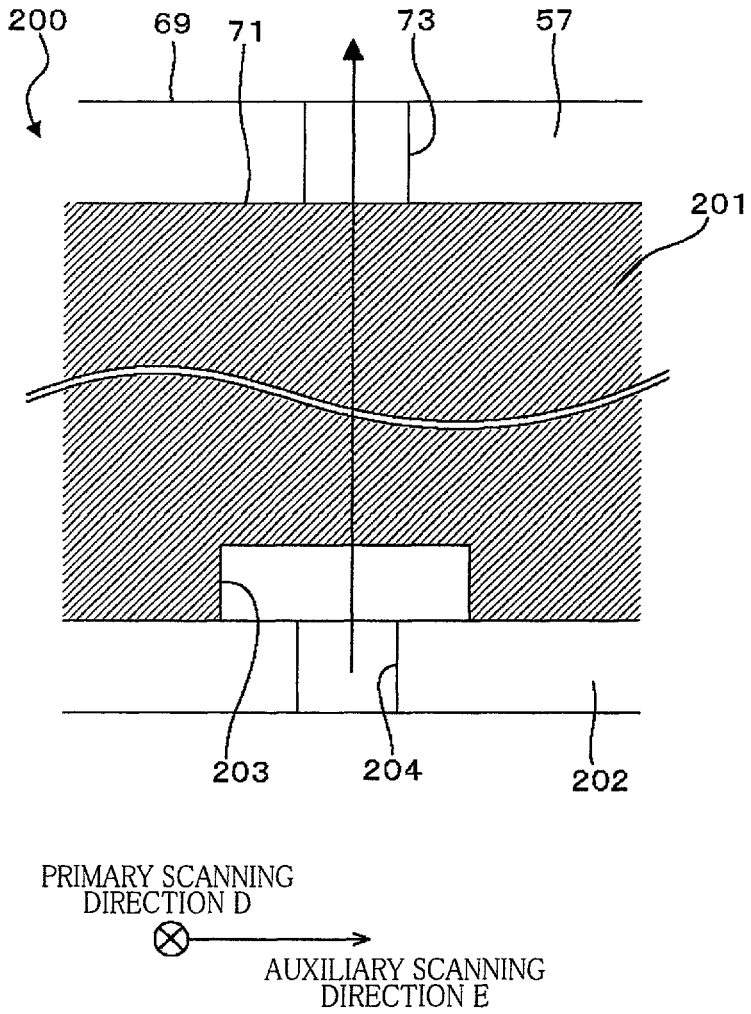
FIG. 11 is an enlarged fragmentary cross sectional view of the second nipping member according to the second embodiment.

Referring next to FIGS. 10 and 11, an ink-jet printer constructed according to a second embodiment of this invention will be described. The ink-jet printer according to the second embodiment is different from the ink-jet printer 1 according to the first embodiment, only in the construction of the second nipping member. The same reference signs as used in the first embodiment will be used to identify the same elements in the first and second embodiments, which will not be described redundantly.

The second nipping member indicated at 200 in FIGS. 10 and 11 is a rotatable roller extending in the primary scanning direction D as in the first embodiment. The second nipping member 200 is disposed in opposition to the first nipping member 41. The second nipping member 200 is an example of one of two nipping members according to this invention.

The second nipping member 200 has the sleeve member 51, an elastic member 201 having an air-permeable property, a film 202 having a liquid-repellant property, and the sucker fan 57, as in the first embodiment.

The elastic member 201 is a cylindrical member covering the outer circumferential surface 71 of the sleeve member 51, as in the first embodiment. The elastic member 201 is disposed such that its outer circumferential surface is in opposition to the first nipping member 41. The elastic member 201 extends in the primary scanning direction D, and a length in the primary scanning direction D, which is larger than the length of the nipping region RG1. A region of the elastic member 201 corresponding to the nipping region RG1 is in opposition to the paper sheet P while the paper sheet P is nipped by and between the first and second nipping members 41, 200. On the other hand, regions of the elastic member 201 corresponding to the non-nipping regions RG2 are not in opposition to the paper sheet P while the paper sheet P is nipped by and between the first and second nipping members 41, 200.

Figure 12:
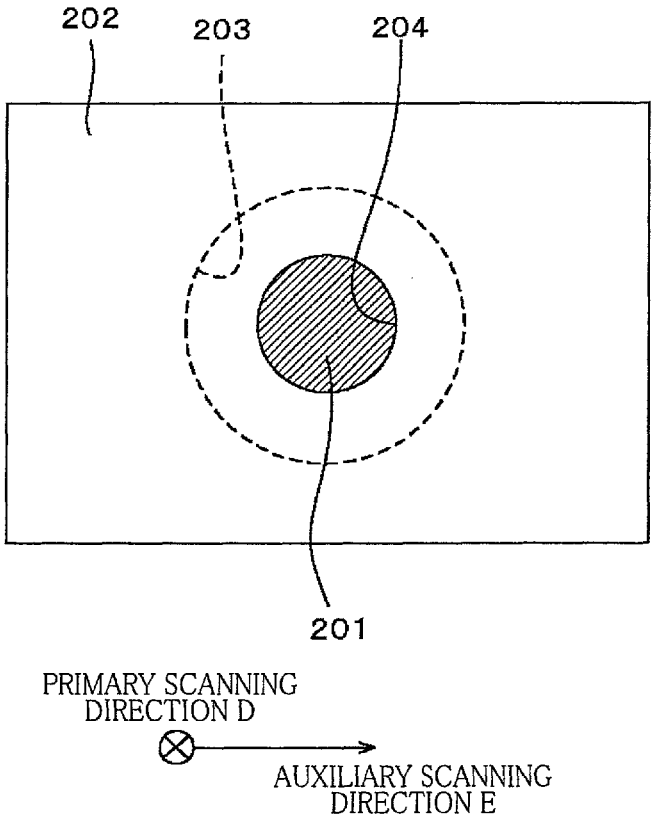
FIG. 12 is an enlarged fragmentary cross sectional view of the second nipping member according to the second embodiment.

As shown in FIGS. 10 and 11, the elastic member 201 has cylindrical recesses 203 formed in its portions opposed to through-holes 204 formed through the film 202 as described below. The cylindrical recesses 203 are formed in the outer circumferential surface of the elastic member 201 such that centerlines of the cylinders of the recesses 203 extend in the radial direction of the elastic member 201. As shown in FIGS. 11 and 12, the recesses 203 have a diameter larger than that of the through-holes 204. In FIG. 12, the recess 203 covered by the film 202 is shown by dotted line, for easier understanding of the diameters of the recess 203 and through-hole 204.

The film 202 is a thin film having a liquid-repellant property, which covers the outer circumferential surface of the elastic member 201, as in the first embodiment. The film 202 extends in the primary scanning direction D, and has a length in the primary scanning direction D, which is larger than the length of the nipping region RG1 and substantially equal to the length of the elastic member 201 in the primary scanning direction D. Namely, the film 202 covers a portion of the outer circumferential surface of the elastic member 201 which corresponds to the nipping region GR1. The film 202 does not cover the end faces of the elastic member 201. That is, the end faces of the elastic member 201 not covered by the film 202 are exposed to the atmosphere.

The film 202 has the medium contact region AR1 which contacts the paper sheet P being nipped by and between the first and second nipping members 41, 200, as in the first embodiment. The medium contact region AR1 corresponds to the nipping region RG1. The film 202 has the plurality of through-holes 204 formed in a zigzag pattern. The film 202 does not have a raised portion as provided in the first embodiment, around an inner open end of each through-hole 204.

While the paper sheet P is fed by and nipped between the first and second nipping members 41, 200, the first nipping member 41 is heated with the heat generated by the heater 47, so that the paper sheet P is heated by the first nipping member 41. As a result, the aqueous components of the inks IK ejected from the printing heads 25 onto the paper sheet P as shown in FIG. 10 are vaporized by the heated first nipping member 41, with a result of generation of a vapor (steam). Namely, the heat is conducted from the first nipping member 41 to the surface of the paper sheet P opposite to the printing surface, and then conducted to the printing surface, causing vaporization of the aqueous components of the inks IK deposited on the printing surface, and consequent generation of a vapor. The vapor generated from the paper sheet P can escape into the elastic member 201 through the plurality of through-holes 204 formed through the film 202 of the second nipping member 200 in contact with the paper sheet P, as shown in FIG. 11.

As described above, the film 202 has the recesses 203 in opposition to the through-holes 204 formed through the film 202, so that the portions of the elastic member 201 in opposition to the through-holes 204 are less likely to be exposed through the through-holes 204 to the inks IK on the paper sheet P, than where the elastic member 201 is not provided with the recesses 203. Namely, a distance between the exposed surface of the elastic member 201 defining the bottom of each recess 203 and the printing surface of the paper sheet P is increased in the presence of the recesses 203, so that a risk of exposure of the elastic member 201 through the through-holes 204 to the inks IK on the printing surface of the paper sheet P is effectively reduced, whereby the elastic member 201 is protected from contacting the inks IK and contamination with the inks IK. Accordingly, a risk of contamination of the paper sheet P with the inks IK transferred from the elastic member 201 is prevented during a printing operation on the paper sheet P while the paper sheet P is in contact with the second nipping member 200. Even if the elastic member 201 is contaminated with the inks IK transferred from the paper sheet P through the through-holes 204, the paper sheet P is not likely to be contaminated with the inks IK transferred from the elastic member 201 during the printing operation, owing to a relatively large distance between the exposed surfaces of the elastic member 201 and the printing surface of the paper sheet P in the presence of the recesses 204.

<Method of Fabricating Second Nipping Member 200>

Then, a method of fabricating the second nipping member 200 will be described.

As in steps S1, S2 and S3 in the first embodiment, the film 202, sleeve member 51 and elastic member 201 are fabricated independently of each other. Then, the elastic member 201 is mounted on the sleeve member 51, as in step S4, such that the outer circumferential surface 71 of the sleeve member 51 is covered by the elastic member 201. Then, the plurality of recesses 203 are formed in the elastic member 201 of a precursor of the second nipping member 200 obtained in step S4, and the plurality of through-holes 204 are formed through the film 202 fabricated in step S1. Subsequently, the outer circumferential surface of the elastic member 201 in which the recesses 203 have been formed is coated with an adhesive agent, and then the film 202 is bonded to the outer circumferential surface of the elastic member 201 with the adhesive agent, such that the recesses 203 in the elastic member 201 are opposed to and aligned with the respective through-holes 204 in the film 202.

Modifications of Second Embodiment

The film 55 may have the through-holes 204 formed in a region or regions outside the medium contact region AR1. Further, the through-holes 204 formed in the central region AR2 and the through-holes 204 formed in the end regions AR3 may have the same degree of density. Alternatively, the through-holes 204 formed in the end regions AR3 have a higher degree of density than the through-holes 204 formed in the central region AR2. The through-holes 204 formed through the film 202 need not be arranged in a zigzag pattern, and may be arranged in a matrix or in a random pattern. The recesses 203 need not have a cylindrical shape, and may have a prismatic shape. The recesses 203 may have a diameter substantially equal to that of the through-holes 204. The cylindrical recesses 203 may be replaced by longitudinal continuous grooves extending in the primary scanning direction D, between the opposite end faces of the elastic member 201. In this case, the longitudinal continuous grooves are formed in parallel with each other and spaced apart from each other at a predetermined angular pitch in the circumferential direction of the elastic member 201. Alternatively, the cylindrical recesses 203 may be replaced by circumferential continuous grooves extending in the circumferential direction of the elastic member 201. In this case, the circumferential continuous grooves are formed in parallel with each other and spaced apart from each other at a predetermined pitch in the longitudinal direction of the elastic member 201 (in the primary scanning direction D). Further alternatively, the cylindrical recesses 203 may be replaced by helical grooves formed in the outer circumferential surface of the elastic member 201, so as to extend at a predetermined angle with respect to the axis of the elastic member 201 (with respect to a plane perpendicular to the axis). Where the continuous grooves are formed in the elastic member 201, the through-holes 204 are formed through the film 202 such that the through-holes 204 are opposed to the continuous grooves.

Third Embodiment

Figure 13:
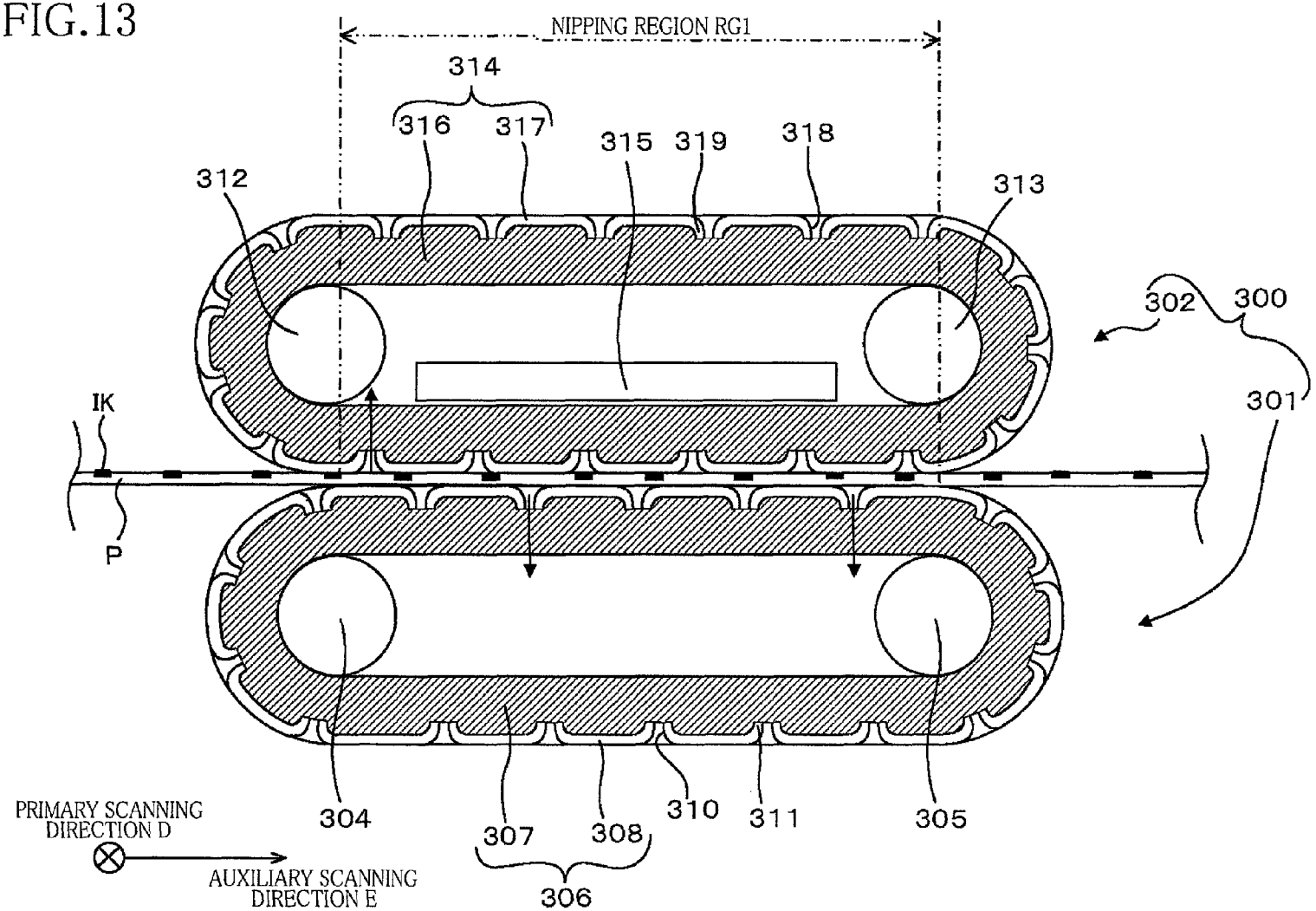
FIG. 13 is a cross sectional view of a heating portion constructed according to a third embodiment of this invention, showing a first nipping member and a second nipping member, while a paper sheet is nipped by and between the first and second nipping members.

Referring next to FIG. 13, an ink-jet printer constructed according to a third embodiment of the present invention will be described. The ink-jet printer according to the third embodiment is different from the ink-jet printers according to the first and second embodiments, only in the construction of the heating portion. The same reference signs as used in the first embodiment will be used to identify the same elements in the first and third embodiments, which will not be described redundantly.

<Heating Potion 300>

The ink-jet printer according to the present third embodiment has a heating portion 300 which has a first nipping member 301 and a second nipping member 302. These first and second nipping members 301, 302 extend in the primary scanning direction D.

The first and second nipping members 301, 302 are examples of two nipping members according to the present invention, and the second nipping member 302 is an example of one of the two nipping members.

As shown in FIG. 13, the first nipping member 301 has two belt rollers 304, 305, a belt 306, and a sucker fan (not shown).

The belt rollers 304, 305 are rotatable metallic rollers extending in the primary scanning direction D. The two belt rollers 304, 305 are disposed in parallel with each other, with a predetermined spacing distance therebetween in the auxiliary scanning direction. The belt rollers 304, 305 have a length in the primary scanning direction D, which is larger than the length of the nipping region RG1. One of the two belt rollers 304, 305 is connected to and rotated by the sheet feeding motor 39.

The belt 306 is an endless member connecting the two belt rollers 304, 305 to each other. The belt 306 is rotated by rotary motions of the belt rollers 304, 305. The belt 306 has a two-layered structure consisting of an elastic member 307 having an air-permeable property, and a film 308 having a liquid-repellant property.

The elastic member 307 is a sleeve member in contact with the belt rollers 304, 305. The elastic member 307 extends in the primary scanning direction D, and has a length in the primary scanning direction D, which is larger than the length of the nipping region RG1. A region of the outer circumferential surface of the elastic member 307 which corresponds to the nipping region RG1 is opposed to the paper sheet P being nipped by and between the first and second nipping members 301, 302.

The film 308 is a thin film which covers the outer circumferential surface of the elastic member 307 and which has a liquid-repellant property. The film 308 extends in the primary scanning direction D, and has a length in the primary scanning direction, which is larger than the length of the nipping region RG1 and almost equal to the length of the elastic member 307 in the primary scanning direction D. Namely, the film 308 covers the region of the outer circumferential surface of the elastic member 307 which corresponds to the nipping region RG1. The film 308 does not cover the end faces of the elastic member 307. That is, the end faces of the elastic member 307 not covered by the film 308 are exposed to the atmosphere.

As in the first embodiment, the film 308 has the medium contact region AR1 in which the film 308 contacts the paper sheet P being nipped by and between the first and second nipping members 301, 302. The film 308 has a plurality of through-holes 310 formed in a zigzag pattern, and a plurality of raised portions 311 through which the respective through-holes 310 are formed. The raised portions 311 protrude toward the elastic member 307 inwardly of the elastic member 307. Each of the raised portions 311 has a generally triangular pyramidal shape with its inner end section embedded in the elastic member 307. Each of the through-holes 310 has an inner end portion formed through the corresponding pyramidal raised portion 311. A portion of the elastic member 307 in which the raised portion 311 is embedded is elastically compressed inwardly of the elastic member 307, so that the inwardly compressed portion is less likely to be exposed through the through-hole 310 to the inks IK on the paper sheet P, than where the film 308 is not provided with the raised portions 311.

The sucker fan is provided to evaluate an internal space within the belt 306, by sucking the air from the internal space. The suction of the air by the sucker fan causes air flows from an external space outside of the first nipping member 301 into the elastic member 307 through the through-holes 310, and air flows from the elastic member 307 into the internal space.

The second nipping member 302 has two belt rollers 312, 313, a belt 314, a heater 315, and a sucker fan (not shown).

The belt rollers 312, 313 are rotatable metallic rollers extending in the primary scanning direction D. The two belt rollers 312, 313 are disposed in parallel with each other, with a predetermined spacing distance therebetween in the auxiliary scanning direction. The belt rollers 312, 313 have a length in the primary scanning direction D, which is larger than the length of the nipping region RG1. One of the two belt rollers 312, 313 is connected to and rotated by the sheet feeding motor 39.

The belt 314 is an endless member connecting the two belt rollers 312, 313 to each other. The belt 314 is rotated by rotary motions of the belt rollers 312, 313. The belt 314 has a two-layered structure consisting of an elastic member 316 having an air-permeable property, and a film 317 having a liquid-repellant property.

The elastic member 316 is a sleeve member in contact with the belt rollers 312, 313. The elastic member 316 extends in the primary scanning direction D, and has a length in the primary scanning direction D, which is larger than the length of the nipping region RG1. A region of the outer circumferential surface of the elastic member 316 which corresponds to the nipping region RG1 is opposed to the paper sheet P being nipped by and between the first and second nipping members 301, 302.

The film 317 is a thin film which covers the outer circumferential surface of the elastic member 316 and which has a liquid-repellant property. The film 317 extends in the primary scanning direction D, and has a length in the primary scanning direction, which is larger than the length of the nipping region RG1 and almost equal to the length of the elastic member 316 in the primary scanning direction D. Namely, the film 317 covers the region of the outer circumferential surface of the elastic member 316 which corresponds to the nipping region RG1. The film 317 does not cover the end faces of the elastic member 316. That is, the end faces of the elastic member 316 not covered by the film 317 are exposed to the atmosphere.

As in the first embodiment, the film 317 has the medium contact region AR1 in which the film 317 contacts the paper sheet P being nipped by and between the first and second nipping members 301, 302. The film 317 has a plurality of through-holes 318 formed in a zigzag pattern, and a plurality of raised portions 319 through which the respective through-holes 318 are formed. The raised portions 319 protrude toward the elastic member 316 inwardly of the elastic member 316. Each of the raised portions 319 has a generally triangular pyramidal shape with its inner end section embedded in the elastic member 316. Each of the through-holes 318 has an inner end portion formed through the inner end section of the corresponding pyramidal raised portion 319. A portion of the elastic member 316 in which the raised portion 319 is embedded is elastically compressed inwardly of the elastic member 316, so that the inwardly compressed portion is less likely to be exposed through the through-hole 318 to the inks IK on the paper sheet P, than where the film 317 is not provided with the raised portions 319.

The heater 315 is disposed in an internal space within the belt 314. When the heater 315 is energized under the control of the control portion 100, the belt 314 is heated with a heat generated by the heater 315.

The sucker fan is provided to evaluate the internal space within the belt 314, by sucking the air from the internal space. The suction of the air by the sucker fan causes air flows from an external space outside of the second nipping member 302 into the elastic member 316 through the through-holes 318, and air flow from the elastic member 316 into the internal space.

A printed image exists on the printing surface of the paper sheet P being nipped by and between the first and second nipping members 301, 302. At this time, the first nipping member 301 contacts the surface of the paper sheet P opposite to the printing surface, while the second nipping member 302 contacts the printing surface of the paper sheet P. The first and second nipping members 301, 302 contact the paper sheet P in the nipping region RG1.

While the paper sheet P is fed by and nipped between the first and second nipping members 30, 302, the second nipping member 302 is heated with the heat generated by the heater 315, so that the paper sheet P is heated by the second nipping member 302. As a result, the aqueous components of the inks IK deposited on the printing surface of the paper sheet P as shown in FIG. 12 are vaporized by the heated second nipping member 302, with a result of generation of a vapor (steam). The vapor generated from the paper sheet P can escape into the elastic member 316 through the plurality of through-holes 318 formed through the film 317 of the second nipping member 302 in contact with the printing surface of the paper sheet P. Further, the vapor generated from the paper sheet P can escape into the elastic member 307 through the plurality of through-holes 310 formed through the film 308 of the first nipping member 301 in contact with the surface of the paper sheet P opposite to the printing surface.

In addition, the vapor generated from the paper sheet P nipped by the first and second nipping members 301, 302 and heated by the second nipping member 302 can escape into the internal spaces within the belts 306, 314, through the through-holes 310, 318 and elastic members 307, 316, in the presence of the sucker fans provided to suck the air from the internal spaces of the belts 306, 314 for thereby evacuating the internal spaces. Thus, the vapor generated from the paper sheet P can escape through the through-holes 310, 318, to prevent the vapor from staying in the nipping region RG1 of the first and second nipping members 301, 302, permitting rapid and efficient drying of the inks IK deposited on the paper sheet P.

Modifications of Third Embodiment

Both of the first and second nipping members 301, 302 need not have the respective belts 306, 307. Namely, at least one of the first and second nipping members 301, 302 is required to have the belt. Similarly, both of the first and second nipping members 301, 302 need not have the respective heaters. Namely, at least one of the first and second nipping members 301, 302 is required to have the heater. The first nipping member need not have the elastic member and the film.

The raised portions 311, 319 through which the through-holes 310, 318 may have any shape other than the triangular pyramidal shape. For example, the raised portions may be cylindrical portions having an axial dimension larger than the thickness of the other portions of the film.

The through-holes 310 318 may be formed through the films 308, 317, without the raised portions 310, 318. That is, the raised portions 310, 318 may be replaced by recesses formed in the elastic members 307, 316, in opposition to and aligned with the through-holes 310, 318.

What is claimed is:

1. A drying apparatus comprising:

a heating portion comprising two nipping members and configured to heat a medium being nipped by and between the two nipping members, wherein one of the two nipping members is disposed in opposition to the other of the two nipping members, and comprises an elastic member having an air-permeable property, and a film which covers a surface of the elastic member in opposition to the other nipping member and which has a liquid-repellant property, wherein the film has a plurality of through-holes formed therethrough, and wherein the film has a plurality of raised portions which protrude toward the elastic member and which partially define the through-holes.

2. The drying apparatus according to claim 1, wherein the one of the two nipping members comprises a sleeve member which has an outer circumferential surface covered by the elastic member, and an inner circumferential surface defining an inner hollow space, wherein the sleeve member has vent holes extending between the outer and inner circumferential surfaces.

3. The drying apparatus according to claim 2, further comprising a sucking mechanism configured to evacuate the inner hollow space of the sleeve member, for thereby causing air flows into the inner hollow space through the vent holes.

4. The drying apparatus according to claim 3, wherein the sucking mechanism is disposed at a position corresponding to an axial portion of the sleeve member other than an axial portion thereof covered by the elastic member, and configured to cause the air flows in an axial direction of the sleeve member.

5. A drying apparatus comprising:

a heating portion comprising two nipping members and configured to heat a medium being nipped by and between the two nipping members, wherein one of the two nipping members is disposed in opposition to the other of the two nipping members, and comprises an elastic member having an air-permeable property, and a film which covers a surface of the elastic member in opposition to the other nipping member and which has a liquid-repellant property, wherein the film has a plurality of through-holes formed therethrough, and wherein the elastic member has recesses formed in opposition to the through-holes in the film.

6. The drying apparatus according to claim 1, wherein the plurality of through-holes formed through the film are arranged in a zigzag pattern.

7. The drying apparatus according to claim 1, wherein the heating portion is configured to feed the medium in a feeding direction while the medium is nipped by and between the two nipping members, and the one of the two nipping members extends in a direction perpendicular to the feeding direction, and wherein the elastic member has a nipping region in which the medium is nipped by the two nipping members, and non-nipping regions which are located outwardly of the nipping region in the direction perpendicular to the feeding direction and in which the elastic member is not covered by the film and is exposed to the atmosphere.

8. A drying apparatus comprising:

a heating portion comprising two nipping members and configured to heat a medium being nipped by and between the two nipping members, wherein one of the two nipping members is disposed in opposition to the other of the two nipping members, and comprises an elastic member having an air-permeable property, and a film which covers a surface of the elastic member in opposition to the other nipping member and which has a liquid-repellant property, wherein the film has a plurality of through-holes formed therethrough, wherein the heating portion is configured to feed the medium in a feeding direction while the medium is nipped by and between the two nipping members, and the one of the two nipping members extends in a direction perpendicular to the feeding direction, wherein the elastic member has a nipping region in which the medium is nipped by the two nipping members, and non-nipping regions which are located outwardly of the nipping region in the direction perpendicular to the feeding direction and in which the elastic member is not covered by the film and is exposed to the atmosphere, wherein the film has a medium contact region in which the film contacts the medium nipped by and between the two nipping members, the medium contact region having a central region corresponding to a central portion of the film in the direction perpendicular to the feeding direction, and end regions which are located outwardly of the central region in the direction perpendicular to the feeding direction, and wherein the through-holes are formed with a higher degree of density in the central region than in the end regions.

9. The drying apparatus according to claim 1, wherein each of at least one of the two nipping members comprises a plurality of belt rollers, and a belt connecting the plurality of belt rollers.

10. The drying apparatus according to claim 9, wherein the heating portion is disposed in an internal space within the belt of one of the at least one of the two nipping members.

11. A recording apparatus comprising:

a recording head having a liquid-ejecting surface and configured to record an image on a recording medium, with a liquid ejected from the liquid-ejecting surface; and a drying apparatus as defined in claim 1, wherein the heating portion heats the recording medium as the medium on which the image has been recorded by the recording head.

12. The recording apparatus according to claim 11, wherein the one of the two nipping members is configured to contact a recording surface of the recording medium on which the image has been recorded by the recording head.

13. The recording apparatus according to claim 12, wherein the heating portion is disposed in an internal space within the other nipping member.

14. The recording apparatus according to claim 11, wherein the two nipping members are two rollers extending in a direction perpendicular to a feeding direction in which the heating portion feeds the recording medium, and the heating portion feeds the recording medium in the feeding direction by rotary motions of the two nipping members while the recording medium is nipped by and between the two nipping members.

15. The recording apparatus according to claim 11, wherein the two nipping members comprise the nipping member in which the heating portion is disposed and which is configured to contact a recording surface of the recording medium on which the image has been recorded by the recording head.

16. A method of fabricating one of two nipping members of a heating portion of a drying apparatus, the heating portion being configured to heat a recording medium being nipped by and between the two nipping members, the one of the two nipping members being disposed in opposition to the other of the two nipping members, and comprising an elastic member having an air-permeable property, and a film which covers a surface of the elastic member in opposition to the other nipping member and which has a liquid-repellant property, the method comprising:

a step of forming a plurality of through-holes through the film, by piercing needle members into the film in a direction from one of opposite surfaces of the film which is remote from the elastic member, toward the other of the opposite surfaces, such that the through-holes are formed through respective raised portions which are formed by the needle members pierced into the film and which protrude toward the elastic member.

17. The method according to claim 16, further comprising a step of covering the elastic member by the film, prior to the step of forming the plurality of through-holes through the film.

* * * * *